US009845973B2

(12) United States Patent
Tsai et al.

(10) Patent No.: US 9,845,973 B2
(45) Date of Patent: Dec. 19, 2017

(54) CASCADE REFRIGERATION SYSTEM

(71) Applicant: WinWay Tech. Co., Ltd., Nanzih Dist., Kaohsiung (TW)

(72) Inventors: Ying-Chi Tsai, Kaohsiung (TW); Yu-Pin Hsu, Kaohsiung (TW); Chia-PIn Sun, Kaohsiung (TW)

(73) Assignee: WINWAY TECH. CO., LTD., Kaohsiung (TW)

( * ) Notice: Subject to any disclaimer, the term of this patent is extended or adjusted under 35 U.S.C. 154(b) by 84 days.

(21) Appl. No.: 14/969,777

(22) Filed: Dec. 15, 2015

(65) Prior Publication Data

US 2017/0167758 A1 Jun. 15, 2017

(51) Int. Cl.

| | |
|---|---|
| ***F25B 7/00*** | (2006.01) |
| ***F25B 49/02*** | (2006.01) |
| ***F25B 43/02*** | (2006.01) |

(52) U.S. Cl.

CPC ..... *F25B 7/00* (2013.01); *F25B 43/02* (2013.01); *F25B 49/02* (2013.01)

(58) Field of Classification Search

CPC .. F25B 7/00; F25B 49/02; F25B 43/02; F25B 39/00; F25B 5/00; F25B 39/02

USPC ..... 62/335, 510

See application file for complete search history.

(56) References Cited

U.S. PATENT DOCUMENTS 6,131,401 A * 10/2000 Ueno ..... A47F 3/04 165/208
6,161,391 A * 12/2000 Trieskey ..... F25B 5/02 62/335
9,200,822 B2 12/2015 Jeon et al.
2008/0156033 A1* 7/2008 Cur ..... F25B 25/00 62/448
2014/0202190 A1 7/2014 Matsui et al.

FOREIGN PATENT DOCUMENTS

| | | | |
|---|---|---|---|
| CN | 1222966 | A | 7/1999 |
| CN | 102226596 | A | 10/2011 |
| CN | 103348200 | A | 10/2013 |
| CN | 103827589 | A | 5/2014 |
| CN | 104350352 | A | 2/2015 |
| EP | 3907056 | A1 | 4/1999 |
| EP | 2679933 | A1 | 1/2014 |
| TW | 196535 | | 12/1992 |

OTHER PUBLICATIONS

Search Report from related Taiwanese Application No. 104120581, dated Jan. 26, 2016.

* cited by examiner

*Primary Examiner* — Mohammad M Ali
(74) *Attorney, Agent, or Firm* — Merchant & Gould P.C.

(57) ABSTRACT

A cascade refrigeration system includes first and second cooling devices. The first cooling device includes a first compressor, a condenser, an expansion device, an evaporator having first and second passages independent from and not communicating with each other, and a first conduit interconnecting the first compressor, the condenser, the expansion device and the first passage. The second cooling device includes a second compressor, a heat exchanger, and a second conduit interconnecting the second compressor, the second passage and the heat exchanger. A circulation switching device includes a switching mechanism connected to the first conduit downstream of the condenser and upstream of the expansion device.

7 Claims, 6 Drawing Sheets

CASCADE REFRIGERATION SYSTEM

FIELD

The disclosure relates to a refrigeration system, and more particularly to a cascade refrigeration system.

BACKGROUND

Referring to FIG. 1, a single refrigerant refrigeration system includes a compressor 11, a condenser 12 disposed downstream of and fluidly connected to the compressor 11, an expansion valve 13 disposed downstream of and fluidly connected to the condenser 12, and an evaporator 14 disposed downstream of the expansion valve 13 and upstream of the compressor 11.

During operation of the refrigeration system, a refrigerant 101 flows into the compressor 11 and is compressed into a high-temperature and high-pressure gasified refrigerant 101, after which it flows into the condenser 12 and is condensed into a normal-temperature and high-pressure liquefied refrigerant 101. Next, the normal-temperature and high-pressure liquefied refrigerant 101 flows into the expansion valve 13 and is converted into a low-temperature and low-pressure liquefied refrigerant 101. Afterwards, the low-temperature and low-pressure liquefied refrigerant 101 flows into the evaporator 14, absorbs heat, and is converted into a low-temperature and low pressure gasified refrigerant 101 which then flows back into the compressor 11. The existing single refrigerant refrigeration system is generally used in an air conditioning system and a refrigeration system. However, the cooling temperature of the existing single refrigerant refrigeration system ranges between 10° C. and 30° C. If a lower temperature refrigeration system is required, a dual refrigerant refrigeration system must be used.

Referring to FIG. 2, an existing dual refrigerant refrigeration system includes a liquefaction unit 15 and a cooling unit 16. The liquefaction unit 15 includes a liquefaction compressor 151, a liquefaction condenser 152 fluidly connected to the liquefaction compressor 151, a liquefaction expansion valve 153 fluidly connected to the liquefaction condenser 152, and a heat exchanger 154 fluidly interconnecting the liquefaction expansion valve 153 and the liquefaction compressor 151. The cooling unit 16 includes a cooling compressor 161 fluidly connected to the heat exchanger 154, a cooling expansion valve 162 fluidly connected to the heat exchanger 154, and a cooling evaporator 163 fluidly connected to the cooling expansion valve 162 and the cooling compressor 161.

The liquefaction unit 15 uses, for example, R404A or R507 refrigerant 105, which can be liquefied at high pressure and normal temperature. The cooling unit 16 uses, for example, R23 refrigerant 106, which cannot be liquefied at high pressure and normal temperature. By virtue of the heat exchanger 154, the refrigerant 105 of the liquefaction unit 15 can liquefy the refrigerant 106 of the cooling unit 16 so that the refrigeration system can provide a cooling temperature of about −85° C.

When a wide range of the cooling temperature is required, the existing practice is to equip the refrigeration system with the single refrigerant refrigeration system and the dual refrigerant refrigeration system simultaneously. However, the production and maintenance costs of these two refrigeration systems are not only relatively high, but also they occupy a substantial space.

SUMMARY

Therefore, an object of the disclosure is to provide a cascade refrigeration system that can alleviate at least one of the drawbacks of the prior arts.

According to the disclosure, a cascade refrigeration system includes a first cooling device, a second cooling device and a circulation switching device.

The first cooling device includes a first compressor, a condenser disposed downstream of the first compressor, a first expansion device disposed downstream of the condenser, an evaporator disposed downstream of the first expansion device, and a first conduit that fluidly interconnects the first compressor, the condenser, the first expansion device and the evaporator and that is configured to circulate a first refrigerant. The evaporator has a first passage connected to the first conduit, and a second passage independent from and not communicating with the first passage.

The second cooling device includes a second compressor, a heat exchanger disposed downstream of the second compressor, and a second conduit fluidly interconnecting the heat exchanger, the second passage and the second compressor.

The circulation switching device includes a switching mechanism connected to the first conduit downstream of the condenser and upstream of the first expansion device, a circulation pipeline fluidly interconnecting the switching mechanism, the heat exchanger and the first compressor, and a circulation expansion device connected to the circulation pipeline downstream of the switching mechanism and upstream of the first heat exchanger. The switching mechanism is switchable between a first position, where the first refrigerant flows through the switching mechanism, the first expansion device, the first passage and back into the first compressor along the first conduit, and a second position, where the first refrigerant flows through the switching mechanism, the circulation expansion device, the heat exchanger and back into the first compressor along the circulation pipeline.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
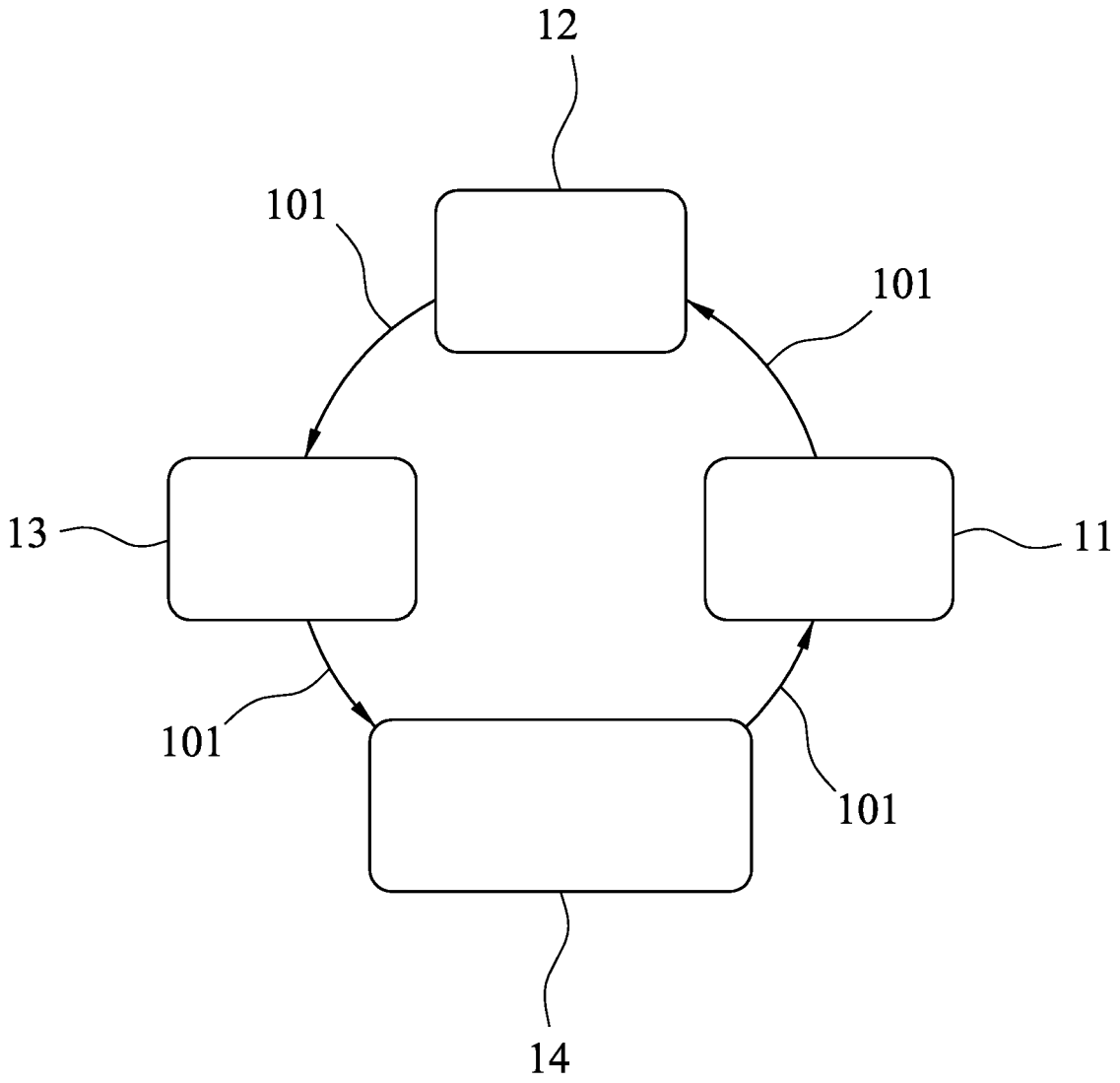
FIG.1 PRIOR ART
FIG. 1 is a schematic diagram illustrating a conventional single refrigerant refrigeration system.
Figure 2:
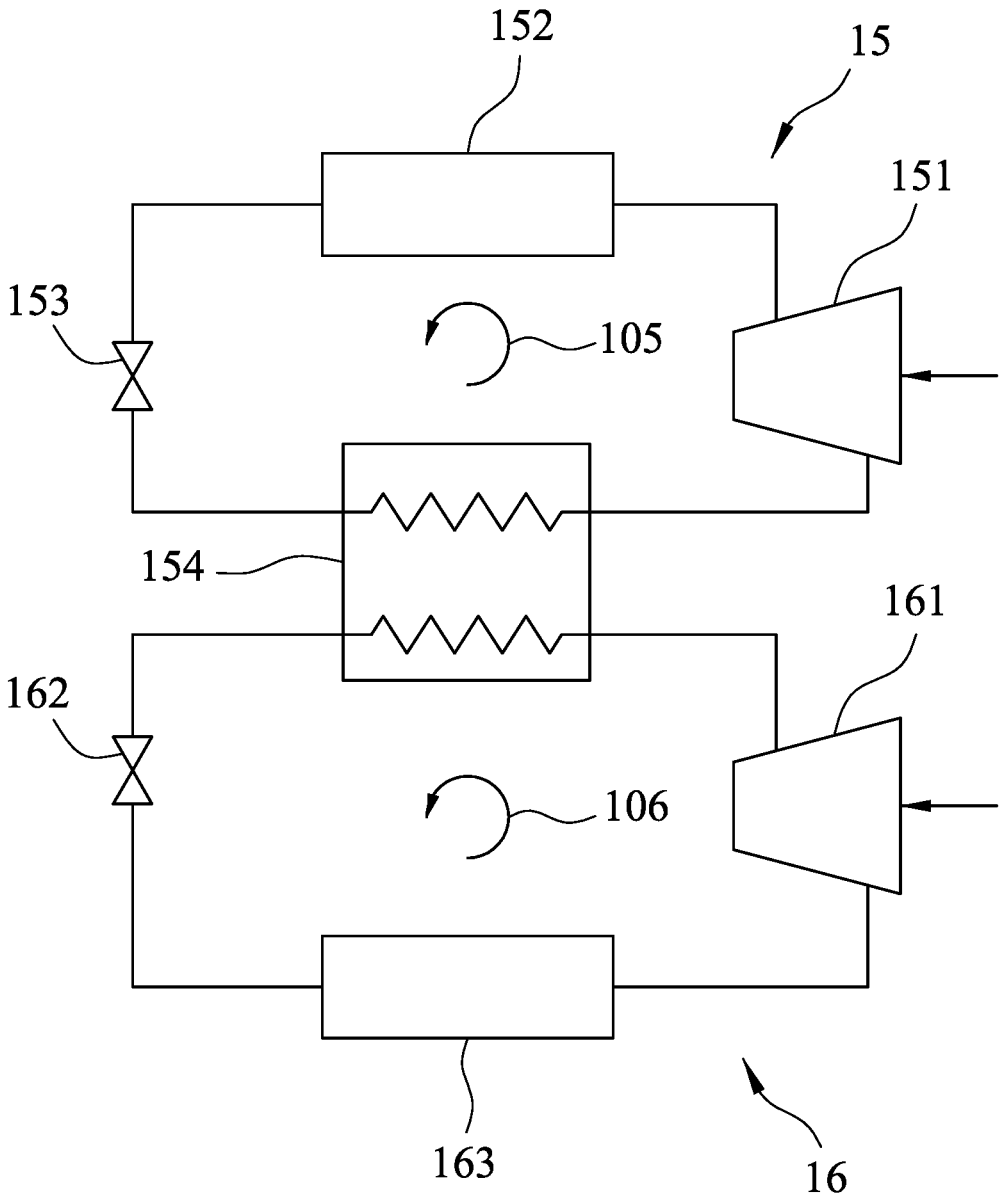
FIG.2 PRIOR ART
FIG. 2 is a schematic diagram illustrating a conventional dual refrigerant refrigeration system.

Before the disclosure is described in greater detail, it should be noted that like elements are denoted by the same reference numerals throughout the disclosure.

Figure 3:
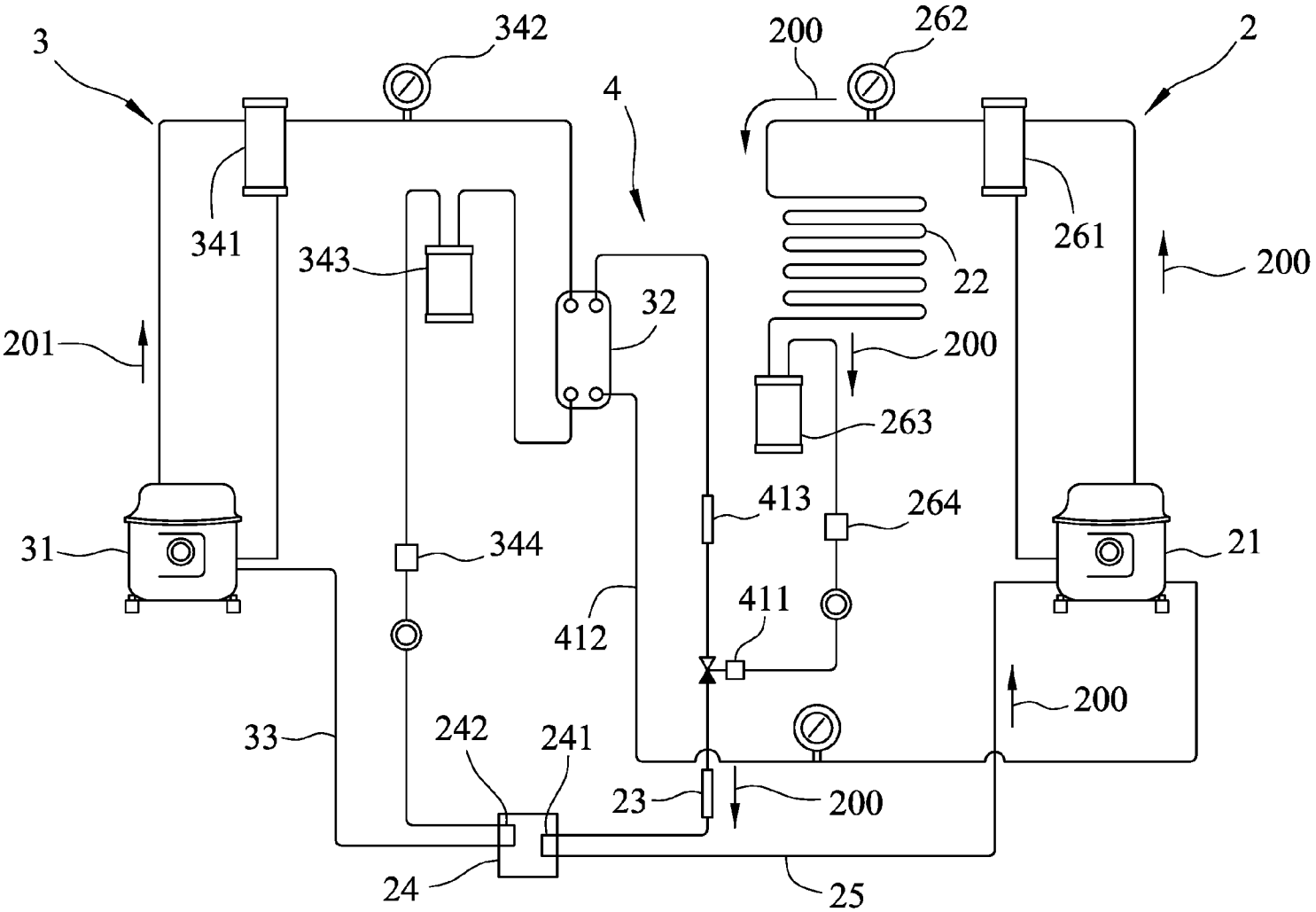
FIG. 3 is a schematic diagram of a first embodiment of a cascade refrigeration system according to the disclosure, illustrating a first switching mechanism of the cascade refrigeration system at a first position.

Referring to FIG. 3, a cascade refrigeration system of a first embodiment according to the disclosure includes a first cooling device 2, a second cooling device 3 and a circulation switching device 4.

The first cooling device 2 includes a first compressor 21, a condenser 22 disposed downstream of the first compressor 21, a first expansion device 23 disposed downstream of the condenser 22, an evaporator 24 disposed downstream of the first expansion device 23 and upstream of the first compressor 21, and a first conduit 25 that fluidly interconnects the first compressor 21, the condenser 22, the first expansion device 23 and the evaporator 24 and that is configured to circulate a first refrigerant 200 which can be liquefied at high pressure and normal temperature.

In this embodiment, the first refrigerant 200 is R507 refrigerant, and the first expansion device 23 is a capillary tube which is used to reduce pressure and temperature of the first refrigerant 200. In practice, the first expansion device 23 may be an expansion valve which can achieve the same effect of the capillary tube.

The evaporator 24 has a first passage 241 connected to the first conduit 25, and a second passage 242 independent from and not communicating with the first passage 241.

In this embodiment, the first cooling device 2 further includes a first oil-gas separator 261 fluidly connected to the first conduit 25 downstream of the first compressor 21 and upstream of the condenser 22, a first high pressure gauge 262 connected to the first conduit 25 between the first oil-gas separator 261 and the condenser 22, a first liquid receiver 263 fluidly connected to the first conduit 25 downstream of the condenser 22, and a first filter drier 264 fluidly connected to the first conduit 25 downstream of the first liquid receiver 263 and upstream of the circulation switching device 4. The first oil-gas separator 261 can separate a lubricant oil of the first compressor 21 and the first refrigerant 200. The first liquid receiver 263 can separate the gasified first refrigerant 200 and the liquefied first refrigerant 200, and can store the liquefied first refrigerant 200. The first filter drier 264 can remove water vapor, moisture and impurities contained in the first refrigerant 200.

The second cooling device 3 includes a second compressor 31, a first heat exchanger 32 disposed downstream of the second compressor 31, and a second conduit 33 fluidly interconnecting the first heat exchanger 32, the second passage 242 and the second compressor 31. The second conduit 33 is configured to circulate a second refrigerant 201 that cannot be liquefied at high pressure and normal temperature. In this embodiment, the second refrigerant 201 is R23 refrigerant.

Besides, the second cooling device 3 further includes a second oil-gas separator 341 fluidly connected to the second conduit 33 downstream of the second compressor 31, a second high pressure gauge 342 connected to the second conduit 33 between the second oil-gas separator 341 and the first heat exchanger 32, a second liquid receiver 343 fluidly connected to the second conduit 33 downstream of the first heat exchanger 32, and a second filter drier 344 fluidly connected to the second conduit 33 downstream of the second liquid receiver 343 and upstream of the second passage 242. Because the effects of the second oil-gas separator 341, the second liquid receiver 343 and the second filter drier 344 are respectively similar to those of the first oil-gas separator 261, the first liquid receiver 263 and the first filter drier 264, the details thereof are omitted herein.

The circulation switching device 4 includes a first switching mechanism 411 connected to the first conduit 25 downstream of the condenser 22 and the first filter drier 264 and upstream of the first expansion device 23, a first circulation pipeline 412 fluidly interconnecting the first switching mechanism 411, the first heat exchanger 32 and the first compressor 21, and a first circulation expansion device 413 connected to the first circulation pipeline 412 downstream of the first switching mechanism 411 and upstream of the first heat exchanger 32.

In this embodiment, the first switching mechanism 411 is a two-position three-way solenoid valve. The first circulation expansion device 413 is a capillary tube which is used to reduce pressure and temperature of the first refrigerant 200. In practice, the first expansion device 23 may be an expansion valve which can achieve the same effect of the capillary tube.

Figure 4:
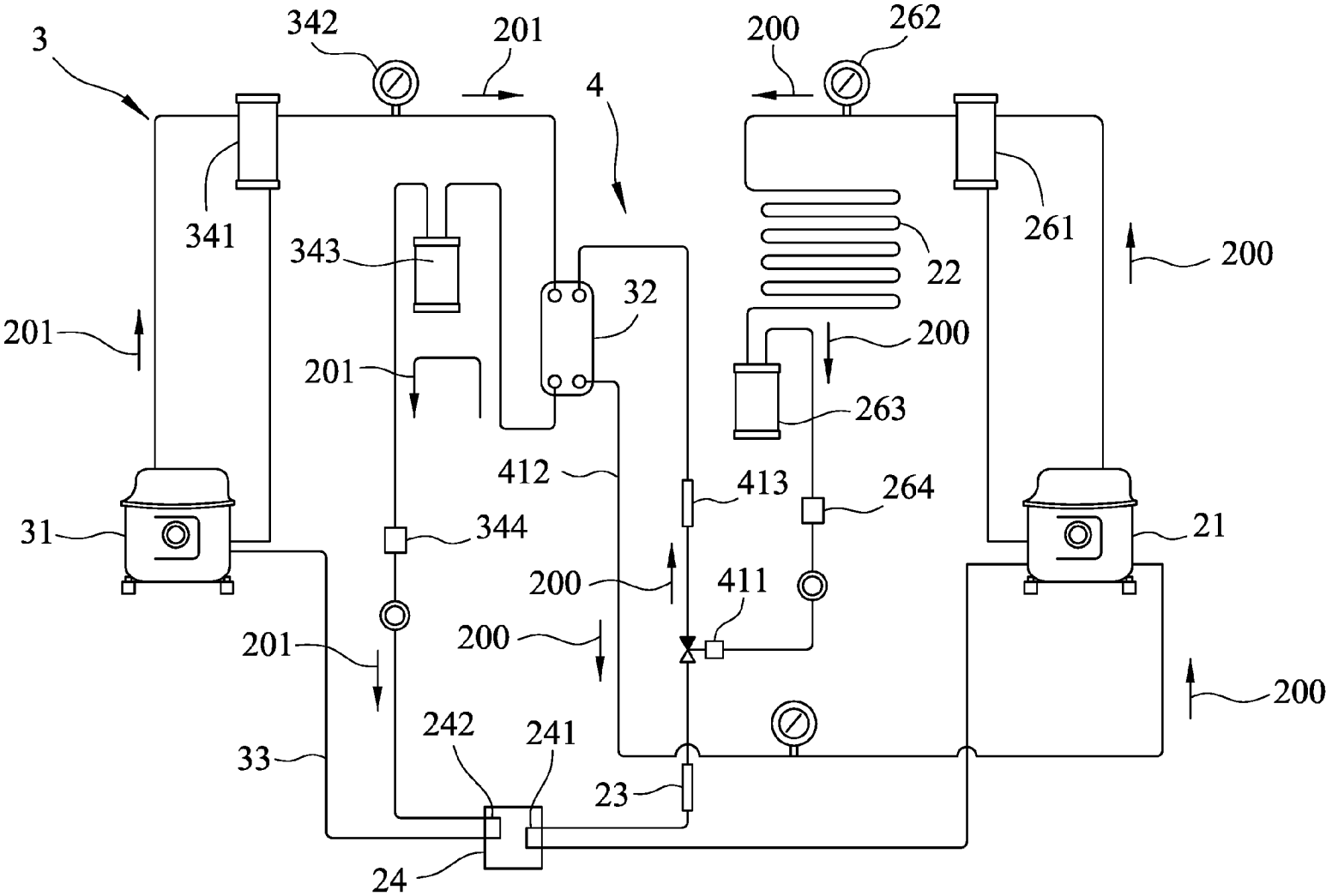
FIG. 4 is a schematic diagram of the first embodiment illustrating the first switching mechanism at a second position.

The first switching mechanism 411 is switchable between a first position, as shown in FIG. 3, and a second position, as shown in FIG. 4.

With reference to FIG. 3, when the first switching mechanism 411 is in the first position, the second compressor 31 is turned off such that the second refrigerant 201 is stopped from circulating along the second conduit 33.

Meanwhile, the first refrigerant 200 flows into the first compressor 21 along the first conduit 25, and is compressed into a high-temperature and high-pressure gasified first refrigerant 200. The high-temperature and high-pressure gasified first refrigerant 200 then flows through the first oil-gas separator 261 into the condenser 22 and is condensed into a normal-temperature and high-pressure liquefied first refrigerant 200 which is stored in the first liquid receiver 263. Next, the normal-temperature and high-pressure liquefied first refrigerant 200 exits from the first liquid receiver 263 and flows through the first filter drier 264 and the first switching mechanism 411 into the first expansion device 23, where the normal-temperature and high-pressure liquefied first refrigerant 200 is converted into a low-temperature and low-pressure liquefied first refrigerant 200. The low-temperature and low-pressure liquefied first refrigerant 200 exiting from the first expansion device 23 then flows through the first passage 241, absorbs heat, and is converted into a low-temperature and low-pressure gasified first refrigerant 200, so that the evaporator can provide a cooling temperature about −50° C. Afterwards, the low-temperature and low-pressure gasified first refrigerant 200 flows back into the first compressor 21 to complete a thermodynamic cycle in the first cooling device 2.

With reference to FIG. 4, when the switching mechanism 411 is in the second position, the normal-temperature and high-pressure liquefied first refrigerant 200 exiting from the first liquid receiver 263 flows to the first circulation expansion device 413 through the first filter drier 264 and the switching mechanism 411. Meanwhile, the first refrigerant 200 in the first passage 241 is temporarily stopped from circulating. The normal-temperature and high-pressure liquefied first refrigerant 200 is converted into a low-temperature and low-pressure liquefied first refrigerant 200 after passing through the first circulation expansion device 413, and flows into the first heat exchanger 32. Through the first heat exchanger 32, the low-temperature and low-pressure liquefied first refrigerant 200 is converted into a low-temperature and low-pressure gasified first refrigerant 200 after absorbing heat in the first heat exchanger 32, and then flows back into the first compressor 21 along the first circulation pipe 412 for continuous circulation in the first cooling device 2.

When the temperature of the first refrigerant 200 is sufficient to liquefy the second refrigerant 201 during heat exchange in the first heat exchanger 32, the second compressor 31 is turned on to compress the second refrigerant 201 that flows therein into a high-temperature and high-pressure gasified second refrigerant 201. The high-temperature and high-pressure gasified second refrigerant 201 exiting from the second compressor 31 then flows to the first heat exchanger 32 through the second oil-gas separator 341 along the second conduit 33. At the first heat exchanger 32, the low-temperature and low-pressure liquefied first refrigerant 200 exchanges heat with the high temperature and high-pressure gasified second refrigerant 201 to convert the second refrigerant 201 into a low-temperature and high-pressure liquefied second refrigerant 201 which then flows to the evaporator 24 through the second liquid receiver 343 and the second filter drier 344. The low-temperature and low-pressure liquefied second refrigerant 201 flows through the second passage 242 of the evaporator 24, absorbs heat, and is converted into a low-temperature and low-pressure gasified second refrigerant 201, so that the evaporator 24 can provide a cooling temperature of below −50° C. or even −70° C. Afterwards, the low-temperature and low-pressure gasified second refrigerant 201 flows back into the second compressor 31 for continuous circulation in the second cooling device 3. It should be noted that when the second refrigerant 201 is circulating in the second passage 242 of the evaporator 24, the first refrigerant 200 in the first passage 241 is temporarily stopped from circulating in the evaporator 24.

By using the first and second passages 241, 242 of the evaporator 24 which are independent from and not communicating with each other, in cooperation with the first switching mechanism 411 which is switchable between first and second positions, the cascade refrigeration system of this embodiment simultaneously has the cooling capacity of a single refrigerant refrigeration system and a dual refrigerant refrigeration system, thereby reducing costs of the refrigeration system and space wastage.

Figure 5:
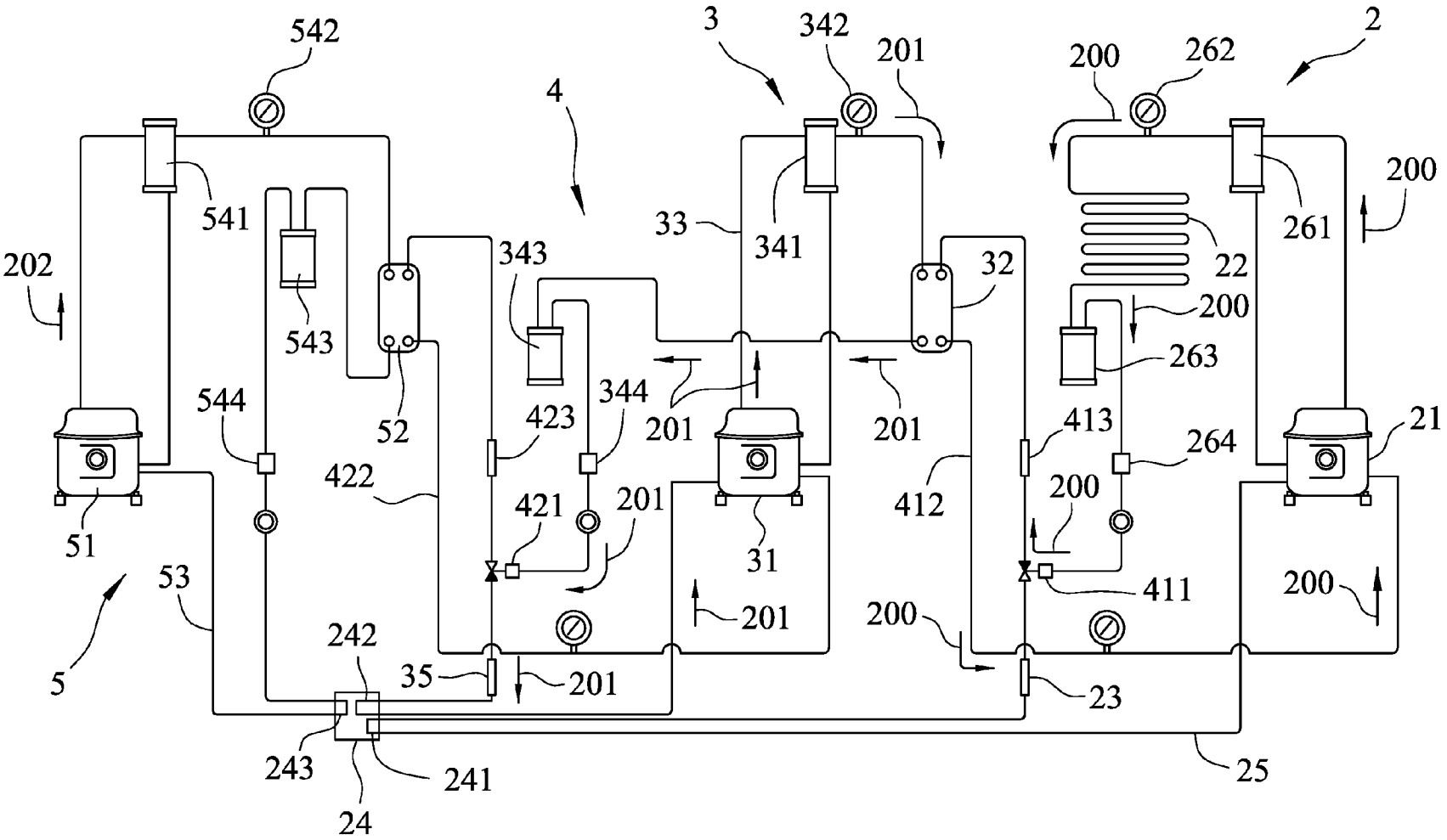
FIG. 5 is a schematic diagram of a second embodiment of a cascade refrigeration system according to the disclosure, illustrating a second switching mechanism of the cascade refrigeration system at a third position.

FIG. 5 illustrates a cascade refrigeration system of a second embodiment according to the present disclosure. The structure and the operation of the second embodiment are similar to those of the first embodiment. The differences between the first and second embodiments reside in that the cascade refrigeration system further includes a third cooling device 5, and the circulation switching device 4 further includes a second switching mechanism 421, a second circulation pipeline 422 and a second circulation expansion device 423. Moreover, the evaporator 24 further has a third passage 243 independent from and not communicating with the first and second passages 241, 242, and the second cooling device 3 further includes a second expansion device 35 fluidly connected to the second conduit 33 downstream of the first heat exchanger 32 and upstream of the evaporator 24. In this embodiment, the second expansion device 35 is a capillary tube.

The third cooling device 5 includes a third compressor 51, a second heat exchanger 52 disposed downstream of the third compressor 51, and a third conduit 53 fluidly interconnecting the third compressor 51, the second heat exchanger 52 and the third passage 243. The third conduit 53 is configured to circulate a third refrigerant 202. In this embodiment, the third refrigerant 202 is a mixed refrigerant that is mixed and adjusted by a user himself according to his requirement.

Besides, the third cooling device 5 further includes a third oil-gas separator 541 fluidly connected to the third conduit 53 downstream of the third compressor 51, a third high pressure gauge 542 connected to the third conduit 53 between the third oil-gas separator 541 and the second heat exchanger 52, a third liquid receiver 543 fluidly connected to the third conduit 53 downstream of the second heat exchanger 52, and a third filter drier 544 fluidly connected to the third conduit 53 downstream of the third liquid receiver 543 and upstream of the third passage 243. Because the functions of the third oil-gas separator 541, the third liquid receiver 543 and the third filter drier 544 are respectively similar to those of the first oil-gas separator 261, the first liquid receiver 263 and the first filter drier 264, the details thereof are omitted herein.

In this embodiment, the second switching mechanism 421 is a two-position three-way solenoid valve connected to the second conduit 33 downstream of the second filter drier 344 and upstream of the second expansion device 35. The second circulation pipeline 422 fluidly interconnects the second switching mechanism 421, the second heat exchanger 52 and the second compressor 31. The second circulation expansion device 423 is a capillary tube connected to the second circulation pipeline 422 downstream of the second switching mechanism 421 and upstream of the second heat exchanger 52.

Figure 6:
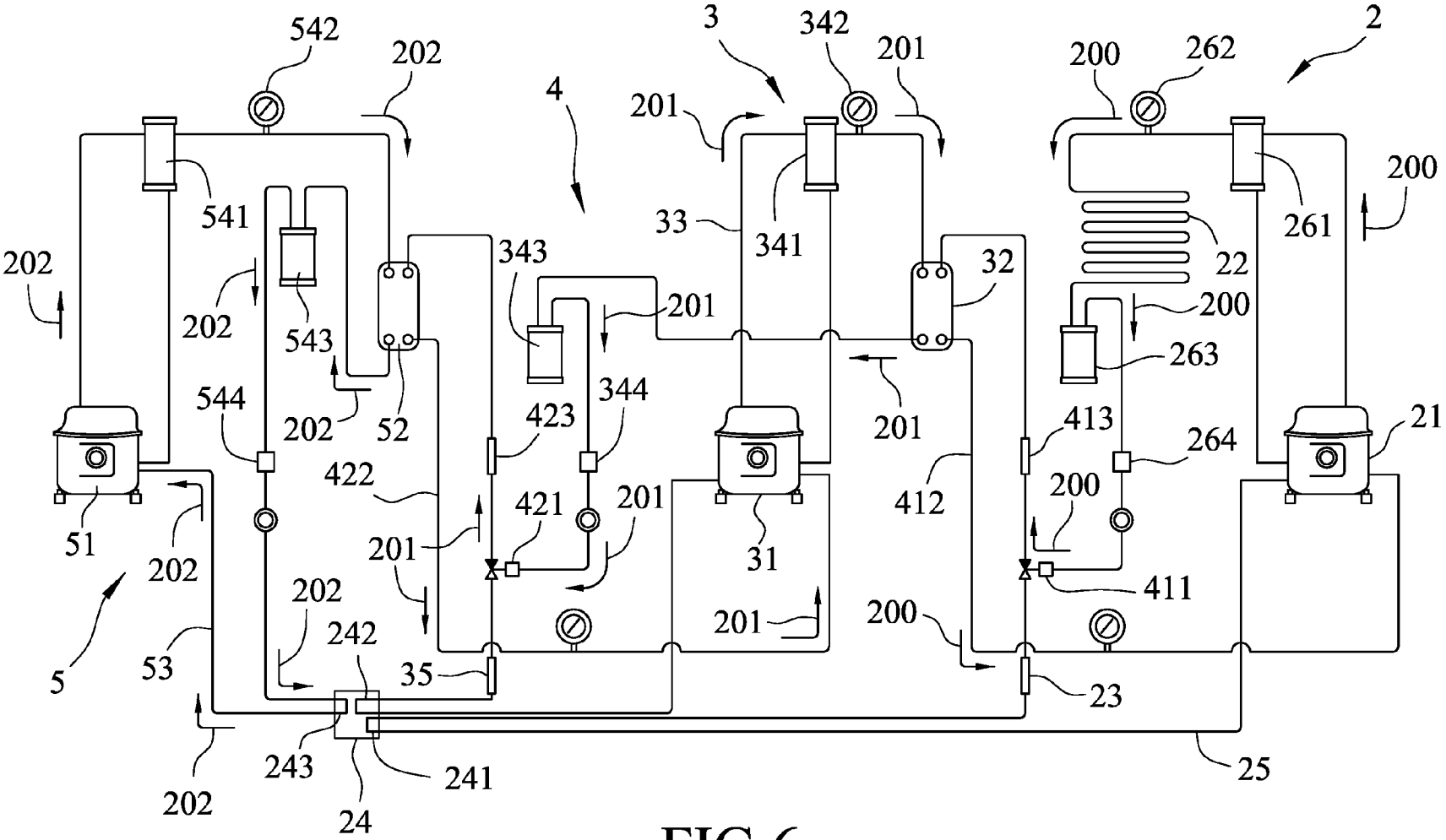
FIG. 6 a schematic diagram of the second embodiment, illustrating the second switching mechanism at a fourth position.

The second switching mechanism 421 is switchable between a third position, as shown in FIG. 5, and a fourth position, as shown in FIG. 6.

With reference to FIG. 5, when the first switching mechanism 411 is in the second position and the second switching mechanism 421 is in the third position, the third compressor 51 is turned off so that the third refrigerant 202 is stopped from circulating along the third conduit 53. Meanwhile, the normal-temperature and high-pressure liquefied second refrigerant 201 exiting from the first heat exchanger 32 flows to the second expansion device 35 through the second liquid receiver 343, the second filter drier 344 and the second switching mechanism 421 along the second conduit 33. By passing through the second expansion device 35, the normal-temperature and high-pressure liquefied second refrigerant 201 is converted into a low-temperature and low-pressure liquefied second refrigerant 201, after which it flows to the evaporator 24. By passing through the second passage 242 of the evaporator 24, the low-temperature and low-pressure liquefied second refrigerant 201 is converted into a low-temperature and low-pressure gasified second refrigerant 201, so that the evaporator 24 can provide a cooling temperature lower than −50° C. or even below −70° C. Afterward, the low-temperature and low-pressure gasified first refrigerant 201 flows back into the second compressor 31 along the second conduit 33.

With reference to FIG. 6, when the first switching mechanism 411 is in the second position and the second switching mechanism 421 is in the fourth position, the normal-temperature and high-pressure liquefied second refrigerant 201 exiting from the first heat exchanger 32 flows to the second circulation expansion device 423 through the second liquid receiver 343, the second filter drier 344 and the second switching mechanism 421 along the second circulation pipeline 422. When passing through the second circulation expansion device 423, the normal-temperature and high-pressure liquefied second refrigerant 201 is converted into a low-temperature and low-pressure liquefied second refrigerant 201, after which it flows to the second heat exchanger 52. Through the second heat exchanger 52, the low-temperature and low-pressure liquefied second refrigerant 201 absorbs heat and is converted into a low-temperature and low-pressure gasified second refrigerant 201, after which it flows back into the second compressor 31 along the second circulation pipeline 422 for continuous circulation.

When the temperature of the second refrigerant 201 is sufficient to liquefy the third refrigerant 202 during heat exchange in the second heat exchanger 52, the third compressor 51 is turned on, so that the third refrigerant 202 that flows into the third compressor 51 is compressed into a high-temperature and high-pressure gasified third refrigerant 202. The high-temperature and high-pressure gasified third refrigerant 202 then flows to the second heat exchanger 52 through the third oil-gas separator 541 along the third conduit 53. At the second heat exchanger 52, the low-temperature and low-pressure liquefied second refrigerant 201 exchanges heat with the high-temperature and high-pressure gasified third refrigerant 202 to convert the high-temperature and high-pressure gasified third refrigerant 202 into a low-temperature and high-pressure liquefied third refrigerant 202 which then flows to the evaporator 24 through the third liquid receiver 543 and the third filter drier 544. When the low-temperature and low pressure liquefied third refrigerant 202 flows through the third passage 243 of the evaporator 24, it absorbs heat and is converted into a low-temperature and low-pressure gasified third refrigerant 202, so that the evaporator 24 can provide a cooling temperature of about −100° C., which is lower than the cooling temperature provided by the evaporator 24 when the low-temperature and low-pressure liquefied second refrigerant 201 flows through the second passage 242. Subsequently, the low-temperature and low-pressure gasified third refrigerant 202 flows back into the third compressor 51.

It should be noted herein that when the third refrigerant 202 is circulating in the third passage 243 of the evaporator 24, the first refrigerant 200 in the first passage 241 and the second refrigerant 201 in the second passage 242 are temporarily stopped from circulating in the evaporator 24. Further, when the first switching mechanism 411 is in the first position (see FIG. 3) and the second and third compressors 31, 51 are turned off, the first cooling device 2 can execute the cooling circulation, as shown in FIG. 3.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment. Various features, aspects, and exemplary embodiments have been described herein. The features, aspects, and exemplary embodiments are susceptible to combination with one another as well as to variation and modification, as will be understood by those having skill in the art.

This disclosure is not limited to the disclosed exemplary embodiments but is intended to cover various arrangements included within the spirit and scope of the broadest interpretation so as to encompass all such modifications and equivalent arrangements.

What is claimed is:

1. A cascade refrigeration system comprising:

a first cooling device including a first compressor, a condenser disposed downstream of said first compressor, a first expansion device disposed downstream of said condenser, an evaporator disposed downstream of said first expansion device, and a first conduit that fluidly interconnects said first compressor, said condenser, said first expansion device and said evaporator and that is configured to circulate a first refrigerant, said evaporator having a first passage connected to said first conduit, and a second passage independent from and not communicating with said first passage;

a second cooling device including a second compressor, a first heat exchanger disposed downstream of said second compressor, and a second conduit fluidly interconnecting said first heat exchanger, said second passage and said second compressor; and a circulation switching device including a first switching mechanism connected to said first conduit downstream of said condenser and upstream of said first expansion device, a first circulation pipeline fluidly interconnecting said first switching mechanism, said first heat exchanger and said first compressor, and a first circulation expansion device connected to said first circulation pipeline downstream of said first switching mechanism and upstream of said first heat exchanger, said first switching mechanism being switchable between a first position, where the first refrigerant flows through said first switching mechanism, said first expansion device, said first passage and back into said first compressor along said first conduit, and a second position, where the first refrigerant flows through said first switching mechanism, said first circulation expansion device, said first heat exchanger and back into said first compressor along said first circulation pipeline;

wherein said second conduit is configured to circulate a second refrigerant, and wherein, when one of the first and second refrigerants is circulating in said evaporator, the other one of the first and second refrigerants is stopped from circulating in said evaporator.

2. A cascade refrigeration system comprising:

a first cooling device including a first compressor, a condenser disposed downstream of said first compressor, a first expansion device disposed downstream of said condenser, an evaporator disposed downstream of said first expansion device, and a first conduit that fluidly interconnects said first compressor, said condenser, said first expansion device and said evaporator and that is configured to circulate a first refrigerant, said evaporator having a first passage connected to said first conduit, and a second passage independent from and not communicating with said first passage;

a second cooling device including a second compressor, a first heat exchanger disposed downstream of said second compressor, and a second conduit fluidly interconnecting said first heat exchanger, said second passage and said second compressor; and a circulation switching device including a first switching mechanism connected to said first conduit downstream of said condenser and upstream of said first expansion device, a first circulation pipeline fluidly interconnecting said first switching mechanism, said first heat exchanger and said first compressor, and a first circulation expansion device connected to said first circulation pipeline downstream of said first switching mechanism and upstream of said first heat exchanger, said first switching mechanism being switchable between a first position, where the first refrigerant flows through said first switching mechanism, said first expansion device, said first passage and back into said first compressor along said first conduit, and a second position, where the first refrigerant flows through said first switching mechanism, said first circulation expansion device, said first heat exchanger and back into said first compressor along said first circulation pipeline;

wherein said first cooling device further includes a first oil-gas separator connected to said first conduit downstream of said first compressor, a first high pressure gauge connected to said first conduit between said first oil-gas separator and said condenser, a first liquid receiver connected to said first conduit downstream of said condenser, and a first filter drier connected to said first conduit downstream of said first liquid receiver and upstream of said first switching mechanism.

3. The cascade refrigeration system as claimed in claim 2, wherein said second cooling device further includes a second oil-gas separator connected to said second conduit downstream of said second compressor, a second high pressure gauge connected to said second conduit between said second oil-gas separator and said first heat exchanger, a second liquid receiver connected to said second conduit downstream of said first heat exchanger, and a second filter drier connected to said second conduit downstream of said second liquid receiver and upstream of said second passage.

4. A cascade refrigeration system comprising:

a first cooling device including a first compressor, a condenser disposed downstream of said first compressor, a first expansion device disposed downstream of said condenser, an evaporator disposed downstream of said first expansion device, and a first conduit that fluidly interconnects said first compressor, said condenser, said first expansion device and said evaporator and that is configured to circulate a first refrigerant, said evaporator having a first passage connected to said first conduit, and a second passage independent from and not communicating with said first passage;

a second cooling device including a second compressor, a first heat exchanger disposed downstream of said second compressor, and a second conduit fluidly interconnecting said first heat exchanger, said second passage and said second compressor; and a circulation switching device including a first switching mechanism connected to said first conduit downstream of said condenser and upstream of said first expansion device, a first circulation pipeline fluidly interconnecting said first switching mechanism, said first heat exchanger and said first compressor, and a first circulation expansion device connected to said first circulation pipeline downstream of said first switching mechanism and upstream of said first heat exchanger, said first switching mechanism being switchable between a first position, where the first refrigerant flows through said first switching mechanism, said first expansion device, said first passage and back into said first compressor along said first conduit, and a second position, where the first refrigerant flows through said first switching mechanism, said first circulation expansion device, said first heat exchanger and back into said first compressor along said first circulation pipeline;

wherein said evaporator further has a third passage independent from and not communicating with said first and second passages, said cascade refrigeration system further comprising a third cooling device that includes a third compressor, a second heat exchanger disposed downstream of said third compressor, and a third conduit fluidly interconnecting said third compressor, said second heat exchanger and said third passage.

5. The cascade refrigeration system as claimed in claim 4, wherein said second conduit is configured to circulate a second refrigerant, said third conduit being configured to circulate a third refrigerant, and wherein, when one of the first, second and third refrigerants is circulating in said evaporator, the other two of the first, second and third refrigerants is stopped from circulating in said evaporator.

6. The cascade refrigeration system as claimed in claim 5, wherein said second cooling device further includes a second expansion device connected to said second conduit downstream of said first heat exchanger and upstream of said evaporator, said circulation switching device further including a second switching mechanism connected to said second conduit downstream of said first heat exchanger and upstream of second expansion device, a second circulation pipeline fluidly interconnecting said second switching mechanism, said second heat exchanger and said second compressor, and a second circulation expansion device connected to said second circulation pipeline downstream of said second switching mechanism and upstream of said second heat exchanger, said second switching mechanism being switchable between a third position, where the second refrigerant flows through said second switching mechanism, said second expansion device, said second passage and back into said second compressor along said second conduit, and a fourth position, where the second refrigerant flows through said second switching mechanism, said second circulation expansion device, said second heat exchanger and back into said second compressor along said second circulation pipeline.

7. The cascade refrigeration system as claimed in claim 6, wherein said third cooling device further includes a third oil-gas separator connected to said third conduit downstream of said third compressor, a third high pressure gauge connected to said third conduit between said third oil-gas separator and said second heat exchanger, a third liquid receiver connected to said third conduit downstream of said second heat exchanger, and a third filter drier connected to said third conduit downstream of said third liquid receiver and upstream of said third passage.

* * * * *